US005894253A

United States Patent [19]

Ichikawa et al.

[11] Patent Number: 5,894,253

[45] Date of Patent: Apr. 13, 1999

[54] ELECTROMAGNETIC RELAY

[75] Inventors: Kazuhiro Ichikawa; Tatsumi Ide; Katsuto Kojima; Akihiro Kaito; Toshihiro Azuma, all of Tokyo, Japan

[73] Assignee: NEC Corporation, Tokyo, Japan

[21] Appl. No.: 08/916,343

[22] Filed: Aug. 22, 1997

[30] Foreign Application Priority Data

Aug. 26, 1996 [JP] Japan ..... 8-223765

[51] Int. Cl.[6] ..... H01H 51/22

[52] U.S. Cl. ..... 335/78; 335/80

[58] Field of Search ..... 335/78–82, 124, 335/128, 129

[56] References Cited

U.S. PATENT DOCUMENTS 4,689,587 8/1987 Schroeder ..... 335/80

4,837,538 6/1989 Dittmann ..... 335/128

FOREIGN PATENT DOCUMENTS 594936 12/1993 Japan .

*Primary Examiner*—Lincoln Donovan

*Attorney, Agent, or Firm*—Sughrue, Mion, Zinn, Macpeak & Seas, PLLC

[57] ABSTRACT

An electromagnetic relay includes a spool, a coil wound on the spool, an armature inserted in the through hole of the spool, a yoke fixed to the spool by fitting, hinge springs, a movable spring, a hinge spring fixing portion, an attaching/fixing portion, and at least one terminal. The armature operates upon excitation of the coil. The yoke has first and second opposing upright portions. One end of the armature is in contact with an end face of the first upright portion, and the other end thereof opposes the end face of the second upright portion. The hinge springs set the armature at a predetermined angle with respect to the yoke, and urge one end of the armature against the end face of the first upright portion to ensure magnetic connection. The movable spring has a movable contact and extends from one side of the hinge springs. The movable spring is connected to the armature. The hinge spring fixing portion extends from the ends side of the hinge springs that are not connected to the movable spring, to support them and the movable spring. The attaching/fixing portion attaches and fixes the hinge spring fixing portion on the first upright portion by a single operation. The terminal member is fixed to one end portion of the spool by press fitting and has a stationary contact adjacent to the movable contact.

17 Claims, 9 Drawing Sheets

ELECTROMAGNETIC RELAY

BACKGROUND OF THE INVENTION

The present invention relates to an electromagnetic relay and, more particularly, to an inexpensive, small-height electromagnetic relay having a high breakdown voltage.

Conventionally, an electromagnetic relay is known in which the contacts are switched by driving an armature inserted in the hollow portion of a coil bobbin. Japanese Utility Model Laid-Open No. 5-94936 discloses a technique as the first prior art technique. According to this technique, a substantially flat plate-like armature is inserted in the hollow portion of a bobbin. A movable spring and the armature are connected to each other with a resin card so that the movable spring and the armature or a yoke will not come into contact with each other. The movable spring and the yoke are insulated from each other with a barrier integrally formed with a base. As a result, an electromagnetic relay having a high breakdown voltage between the contact and coil can be obtained.

The second prior art technique will be described with reference to FIG. 9. According to this prior art technique, a core 1003 is inserted in the cylindrical hollow portion of a spool 1001, and a coil 1002 is wound on the spool 1001 about the core 1003 as the center. One end of an L-shaped yoke 1004 is caulked at the lower end of the core 1003. One end of an armature 1011 supported by hinge springs 1009 caulked on the rear surface of the L-shaped yoke 1004 is in contact with the upper end of the upright portion of the L-shaped yoke 1004. The other end of the armature 1011 opposes the upper end of the core 1003.

The armature 1011 is connected to the hinge springs 1009 through a boss 1010. The other end of each hinge spring 1009 opposite to its hinge portion forms a movable spring 1008. A movable contact 1007 is formed on the distal end portion of the movable spring 1008. Stationary contacts 1006 are arranged to constitute a pair through the movable contact 1007. The opening portion of the case is sealed with an epoxy-based adhesive.

The conventional electromagnetic relay described above has problems as follows. The first problem is the high manufacturing cost. This is because the number of components is large.

The second problem is that the electromagnetic relay does not have a high breakdown voltage. This is because the excitation coil side (primary) and the contact side (secondary) are connected to each other through the space around the card.

The third problem is that the electromagnetic relay cannot be made compact. This is because the yoke needs a space for caulking the hinge spring stationary portion.

SUMMARY OF THE INVENTION

It is an object of the present invention to provide a compact electromagnetic relay having a low manufacturing cost and a high breakdown voltage.

In order to achieve the above object, according to the present invention, there is provided an electromagnetic relay comprising a spool having a through hole, a cylindrical excitation coil wound on the spool, an armature inserted in the through hole of the spool to operate upon excitation of the excitation coil, a substantially U-shaped yoke fixed to two end portions of the spool by fitting, the yoke having first and second opposing upright portions, and one end of the armature being in contact with an end face of the first upright portion of the yoke and the other end of the armature opposing the end face of the second upright portion of the yoke, L-shaped hinge springs for setting the armature at a predetermined angle with respect to the yoke and urging the one end of the armature against the end face of the first upright portion of the yoke to ensure magnetic connection, a movable spring having a movable contact at a distal end thereof and extending from one end of the hinge springs to be connected to the armature, a hinge spring fixing portion extending from the ends of the hinge springs that are not connected to the movable spring, to support the hinge springs and the movable spring, an attaching mechanism for attaching and fixing the hinge spring fixing portion on an outer side surface of the first upright portion of the yoke by a single operation, and at least one terminal member fixed to one end portion of the spool by press fitting, the terminal member having a stationary contact adjacent to the movable contact of the movable spring.

DESCRIPTION OF THE PREFERRED EMBODIMENTS

The present invention will be described in detail with reference to the accompanying drawings.

Figure 1:
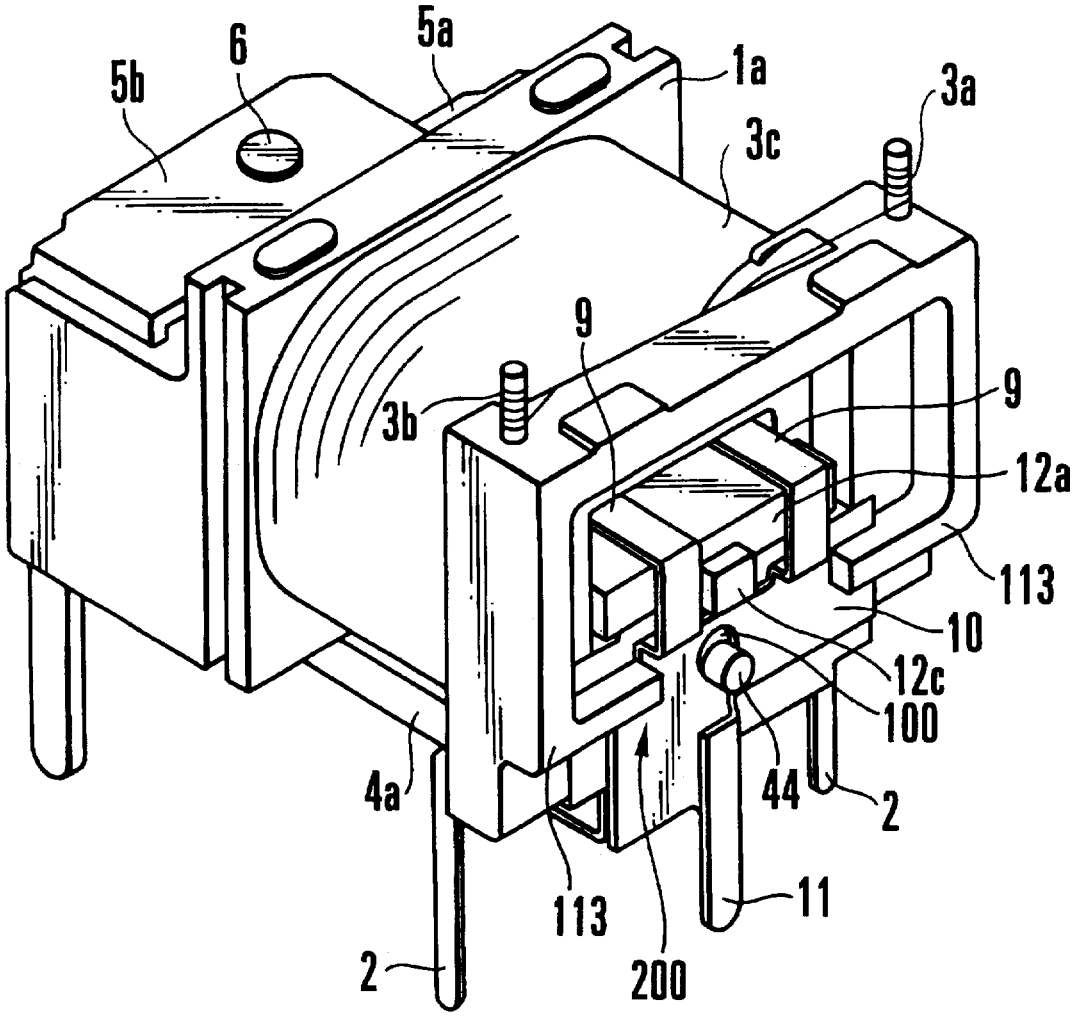
FIG. 1 is a perspective view showing the main body of an electromagnetic relay according to the first embodiment of the present invention.
Figure 2:
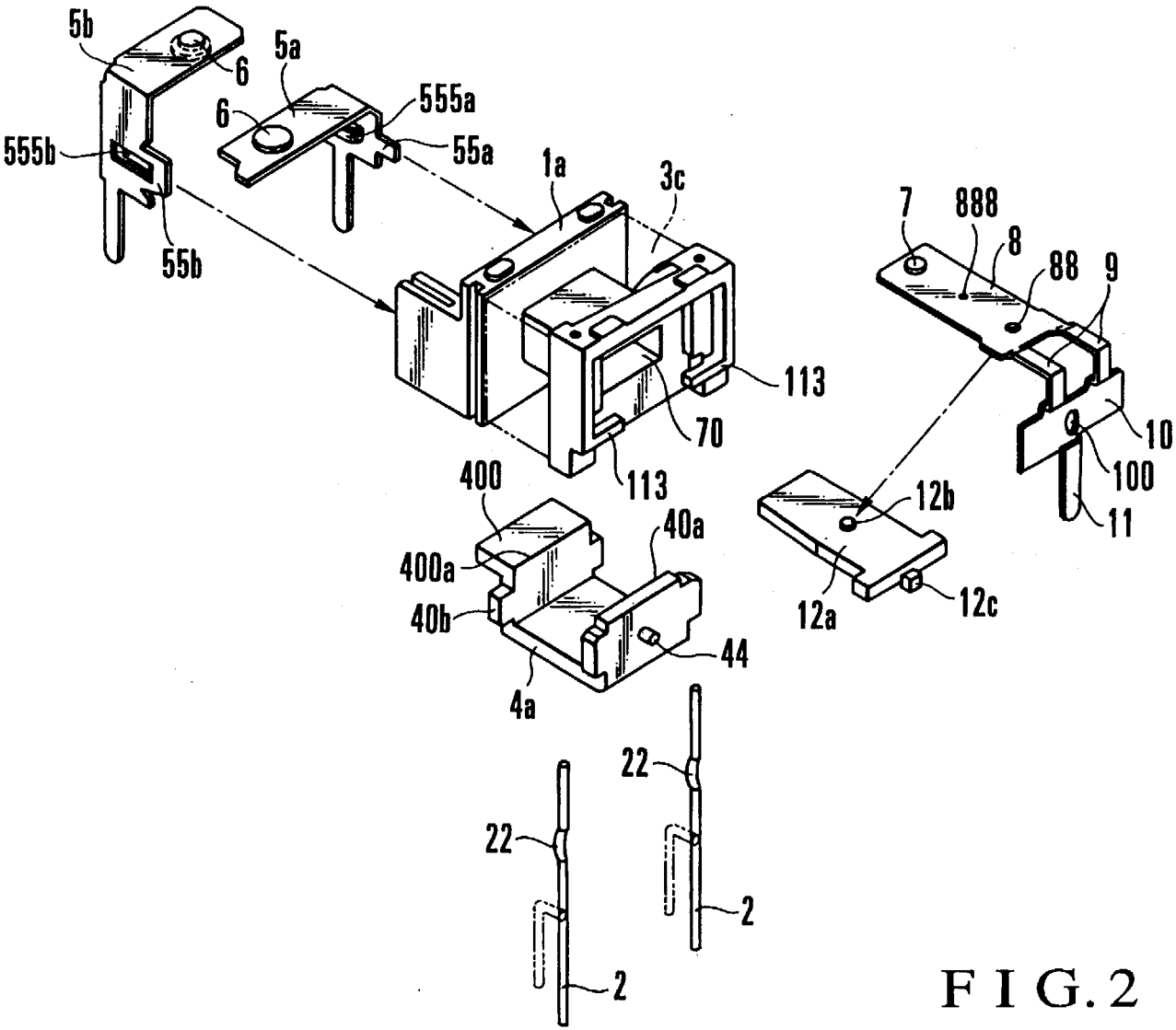
FIG. 2 is an exploded perspective view showing the main body of the electromagnetic relay shown in FIG. 1.

FIGS. 1 and 2 show an electromagnetic relay according to the first embodiment of the present invention. Referring to FIGS. 1 and 2, round rod-shaped coil terminal members 2 made of an Ni—Cu alloy are fixed on a spool 1*a* having an I-shaped side surface by press fitting from below the spool 1*a*. The spool 1*a* is made of a thermoplastic resin and has flange portions on its two ends. Holding and rotation preventive squeezed portions 22 are formed on the coil terminal members 2 in advance. One end of a winding is tied up on an IN-side coil tie-up portion 3*a* and wound on the spool 1*a* by a predetermined number of times to form a coil 3*c*. The other end of the winding is tied up on an OUT-side coil tie-up portion 3*b*, and the two ends of the winding of the coil 3*c* are fixed with solder, thereby completing a coil bobbin.

A yoke 4*a* with a substantially U-shaped side surface and made of pure iron, which has a pair of opposing upright portions 40*a* and 40*b*, is fixed on the two ends of the spool 1*a* having the I-shaped side surface by fitting. The first and second upright portions 40*a* and 40*b* of the yoke 4*a* oppose an inner hole 70 of the spool 1*a*. The insulating distance between the coil 3*c* and the yoke 4*a* is set by adjusting the length of the first and second upright portions 40*a* and 40*b*. Subsequently, terminals 5*a* and 5*b* each having a substantially L-shaped side surface and formed of a lead frame member are fixed on one end portion of the spool 1*a* by press fitting. Stationary contacts 6 made of a silver-oxide complex alloy are formed on the terminals 5*a* and 5*b*, respectively, by caulking. When fixing the yoke 4*a* and the terminals 5*a* and 5*b* with each other, they are fitted with the press-fit portions of the spool 1*a* with an interference fit of several ten μm. The press-fit stroke is determined by abutment with the respective components and the press-fit portions of the spool 1*a*. The stationary contacts 6 of the terminals 5*a* and 5*b* are located at positions to oppose a movable contact 7.

A movable spring 8, a pair of hinge springs 9, and a hinge spring fixing portion 10 are made integrally of a coil material for springs, and the movable contact 7 is caulked at the distal end portion of the movable spring 8. The hinge springs 9 are formed to each have an L-shaped side surface, and the rectangular movable spring 8 and the hinge spring fixing portion 10 extend from the two ends of the hinge springs 9. The movable spring 8 is arranged on an armature 12*a*, and a circular hole 88 of the movable spring 8 is fitted on a projection 12*b* formed on the upper surface of the armature 12*a*, so that the movable spring 8 is connected to the armature 12*a*. At this time, the movable spring 8 should not float from or be pressed on the armature 12*a*.

The armature 12*a* connected to the movable spring 8 is inserted in the inner hole 70 of the spool 1*a* and is set in position by aligning the outer side surface of the upright portion 40*a* of the yoke 4*a* and one end of the armature 12*a* with a pawl portion 12*c*. Simultaneously, the movable contact 7 of the movable spring 8 opposing from the inner hole 70 of the spool 1*a* is arranged between the stationary contacts 6 of the terminals 5*a* and 5*b*. At this time, the hinge spring fixing portion 10 is not in contact with the outer side surface of the upright portion 40*a* of the yoke 4*a* due to the bending angle of the hinge springs 9 that apply a breaking contact pressure to the movable contact 7.

The hinge spring fixing portion 10 is brought into contact with the outer side surface of the upright portion 40*a* of the yoke 4*a* while pulling its common terminal 11 in the direction of its distal end such that a pair of opposing rod-shaped projecting pieces 113 formed on the end face of the spool 1*a* do not come into contact with the upper portions of the two sides of the hinge spring fixing portion 10. As a result, an elliptic hole 100 formed at the center of the hinge spring fixing portion 10 engages with a circular projecting portion 44 formed on the outer side surface of the upright portion 40*a* of the yoke 4*a*. The pair of rod-shaped projecting pieces 113, the elliptic hole 100 of the hinge spring fixing portion 10, and the circular projecting portion 44 of the upright portion 40*a* of the yoke 4*a* constitute an attaching/fixing portion 200 of the hinge spring fixing portion 10 for the yoke 4*a*.

This will be described in detail. The elliptic hole 100 of the hinge spring fixing portion 10 is engaged with the circular projecting portion 44 of the upright portion 40*a* of the yoke 4*a* while-biasing the common terminal 11 downward, such that the hinge springs 9 extend between the pair of opposing rod-shaped projecting pieces 113 and that the hinge spring fixing portion 10 extends below the rod-shaped projecting pieces 113. When the elliptic hole 100 is engaged with the circular projecting portion 44 and is held by it, the rotation moment and the vertically upward pulling force of several 100 gw are applied to the common terminal 11 by the hinge springs 9.

In this embodiment, a gap corresponding to the thickness of the hinge spring fixing portion 10 is set between the outer side surface of the upright portion 40*a* of the yoke 4*a* and the rod-shaped projecting pieces 113. When the common terminal 11 which is held is released vertically upward against the rotation moment described above, the two end portions of the hinge spring fixing portion 10 are automatically inserted in the gap between the outer side surface of the upright portion 40*a* of the yoke 4*a* and the rod-shaped projecting pieces 113. As a result, the hinge spring fixing portion 10 is fixed such that it will not be disengaged even if it receives the rotation moment from the hinge springs 9. Due to engagement of the circular projecting portion 44 and elliptic hole 100, the hinge spring fixing portion 10 will not be pulled vertically upward stronger than necessary, and a pressure applied from the armature 12*a* to the yoke 4*a*, which is necessary to obtain desired characteristics, is ensured. After this, a known case made of a transparent resin and having an opening portion is placed on the main body of the electromagnetic relay, and the opening portion is sealed.

As described above, in the main body of the electromagnetic relay according to the present invention, when compared to the conventional examples, a card that interlocks the contact springs and the armature can be eliminated, and the main body can be assembled very easily. Because of the unique hinge spring fixing method, the step of caulking the hinge spring fixing portion and the yoke is not required, unlike in the conventional case, and extra spaces for caulking need not be reserved in both the hinge spring fixing portion and the yoke, thus achieving downsizing.

A method of assembling the main body of the electromagnetic relay having the above arrangement will be described in detail.

Nickel silver coil terminals each having a diameter of 0.56 mm are press-fitted in the spool 1*a* made of polybutylene terephthalate (30%-glass reinforced). Each rotation preventive squeezed portion 22 has a length of 1 mm and a width of 0.65 mm with respect to the press-fit holes (with a diameter of 0.6 mm) of the spool 1*a*. The coil 3*c* made of a polyurethane copper wire is tied up on the IN-side coil tie-up portion 3*a*, is wound on the spool 1*a*, and is then tied up on the OUT-side coil tie-up portion 3*b*. Thereafter, the two tie-up portions 3*a* and 3*b* are soldered. The two tie-up portions 3*a* and 3*b* have a length of 1.5 mm.

An electromagnetic soft-iron plate (thickness: 1 mm) is bent to form the yoke 4*a* having the pair of upright portions 40*a* and 40*b*. The upper half of the upright portion 40*b* is further bent 90° to form a magnetic pole surface 400. In this embodiment, the outer curved side surface of this 90°-bent portion 400*a* is further formed to have corners in order to increase the area of the magnetic pole surface 400. Subsequently, positioning is performed with respect to the yoke 4*a* by using the inner side surfaces of the pair of upright portions 40*a* and 40*b* as the press-fit surfaces and the two upper end faces of the portions 40*a* and 40*b* as the abutting surfaces. The circular projecting portion 44 of the upright portion 40*a* is formed by embossing to have a diameter of 1 mm and a height of 0.8 mm.

The stationary contact 6 is formed on one side of each of the pair of terminals 5*a* and 5*b* made of a 0.4-mm thick high-conductivity lead frame member, and the other side of each of the terminals 5*a* and 5*b* is cut and raised in a cantilevered manner to form a tongue piece 555*a* or 555*b* having a width of 1 mm and a length of 1 to 2 mm. Projecting portions 55*a* and 55*b* are formed on the tongue pieces 555*a* and 555*b* at the forward portions in the press-fit direction on the same surfaces, respectively. When fixing the terminals 5*a* and 5*b* in the spool 1*a* by press fitting, the projecting portions 55*a* and 55*b* serve as the guides. As the terminals 5*a* and 5*b* are inserted, they are fixed in the spool 1*a* by, press fitting, with the upper and lower end faces of the tongue pieces 555*a* and 555*b*. The press-fit stroke is determined by abutment of the end face of the vertical portion, thereby positioning the respective stationary contacts 6.

The armature 12*a* made of an electromagnetic soft-iron plate (thickness: 1 mm) has the projection 12*b* (diameter: 1 mm; height: 0.5 mm) formed by embossing at substantially its center, and is connected to the circular hole 88 formed in the movable spring 8. The pawl portion 12*c* of the armature 12*a* is formed by punching only half the plate thickness separately from the portion of the armature 12*a* which is formed into the projecting shape by press punching, and is used for positioning the armature 12*a* and the end face of the yoke 4*a* with each other.

The movable spring 8, the hinge springs 9, and the hinge spring fixing portion 10 are integrally press-punched from a high-conductive spring member having a thickness of 0.14 mm. The movable contact 7 is formed on the movable spring 8 by caulking, and thereafter the hinge springs 9 and the common terminal 11 are bent at predetermined angles, thereby forming the entire spring portion. A small circular hole 888 formed at substantially the center of the movable spring 8 is used for load characteristics inspection performed after the main body is completed.

Figure 3:
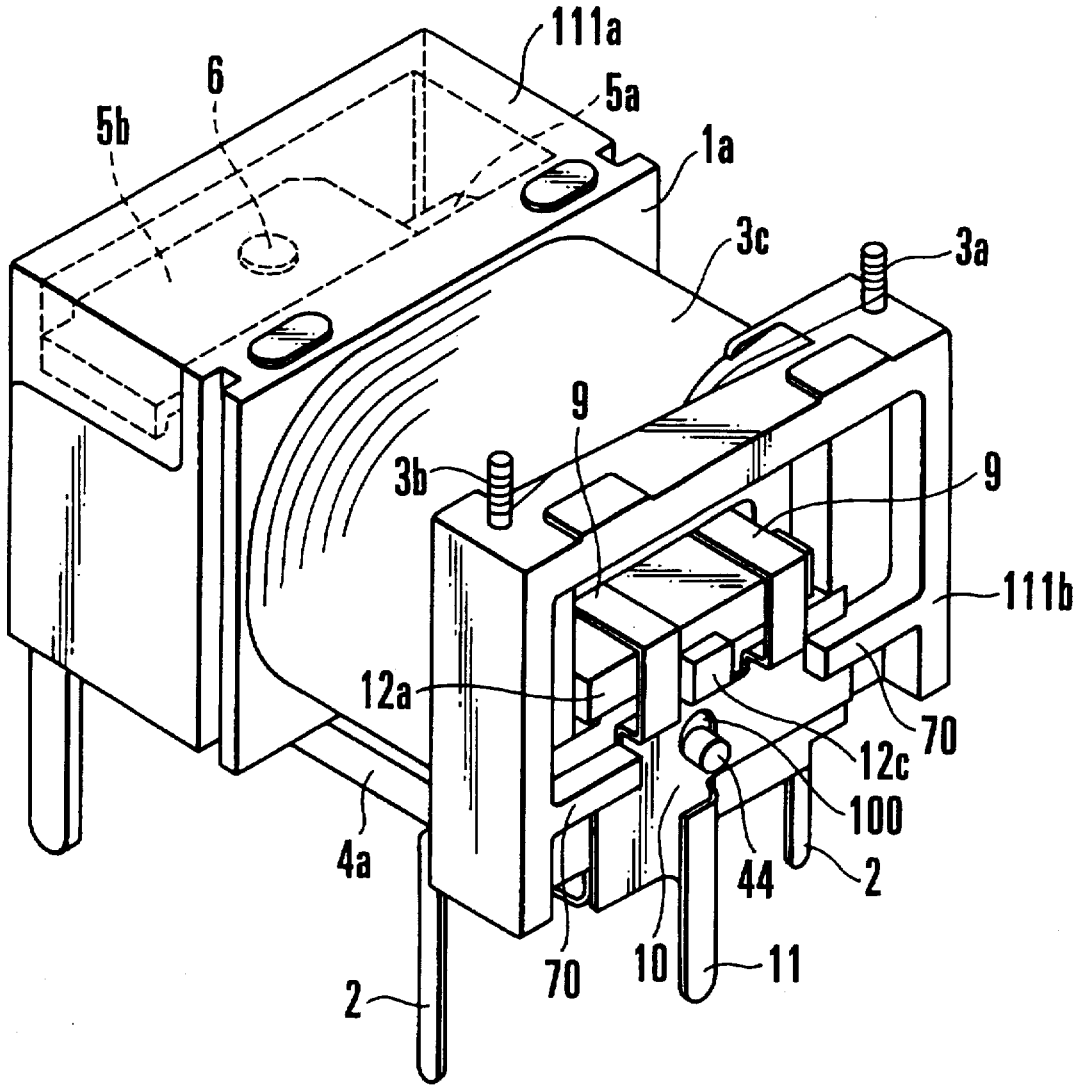
FIG. 3 is a perspective view showing the main body of an electromagnetic relay according to the second embodiment of the present invention.

FIG. 3 shows the main body of an electromagnetic relay according to the second embodiment of the present invention. In FIG. 3, the same portions as in FIGS. 1 and 2 are denoted by the same reference numerals, and a detailed description thereof will be omitted. Referring to FIG. 3, cylindrical portions 111*a* and 111*b* for respectively accommodating a contact portion and hinge spring portions are formed on the two end portions of a spool 1*b*. With this structure, after the main body is assembled, the opening portions of the cylindrical portions 111*a* and 111*b* mate with the inner wall of the case in which the main body is to be mounted. The opening portion of the case is sealed with an epoxy-based adhesive, thereby remarkably improving insulation between the coil and the contact.

Figure 4:
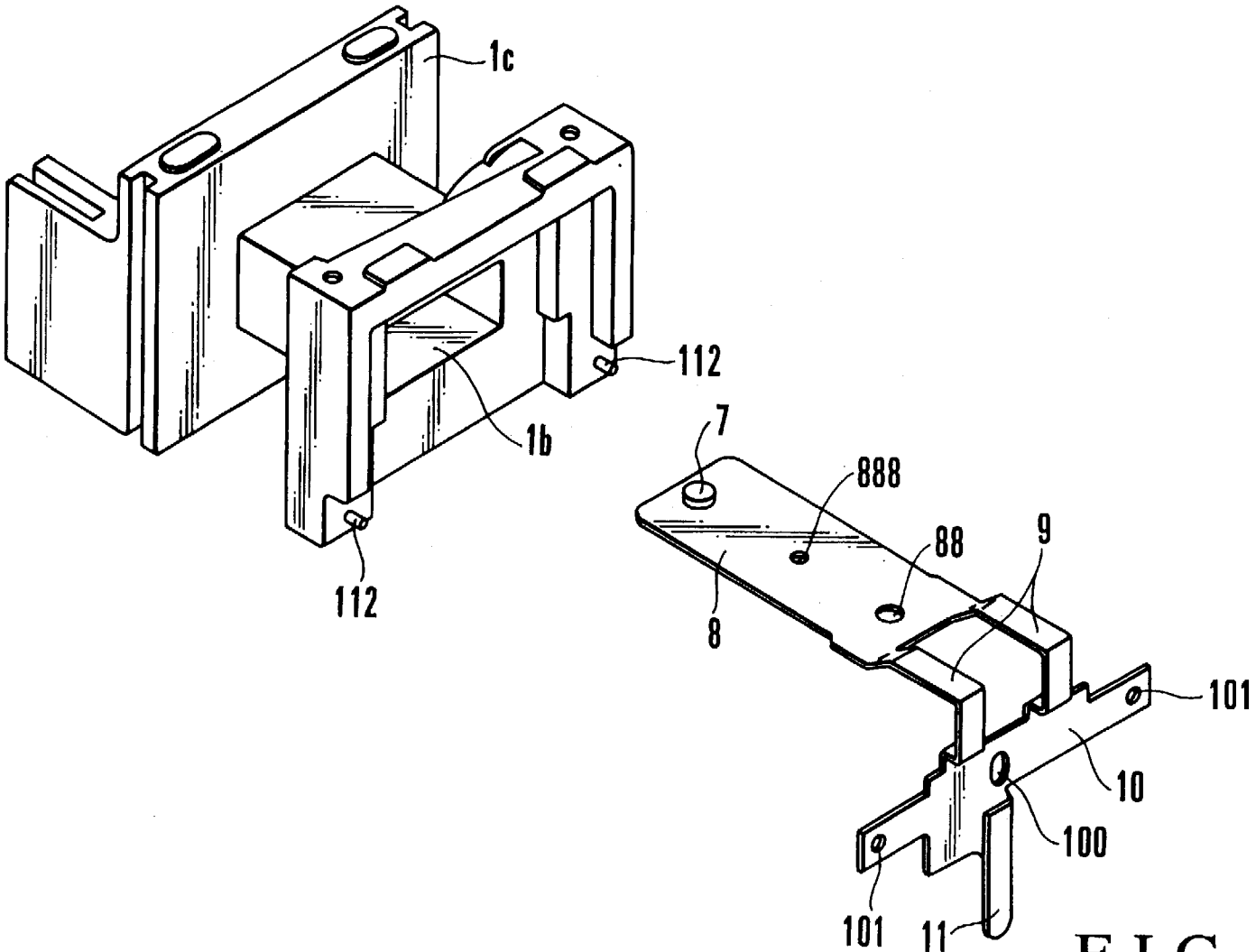
FIG. 4 is an exploded perspective view showing the main part of the main body of an electromagnetic relay according to the third embodiment of the present invention.

FIG. 4 shows the main part of the main body of an electromagnetic relay according to the third embodiment of the present invention and indicates another method of fixing the hinge spring portion. In FIG. 4, the same portions as in FIGS. 1 and 2 are denoted by the same reference numerals, and a detailed description thereof will be omitted. Referring to FIG. 4, pins 112 are arranged on the one-end face of a spool 1*c*, and are engaged with holes 101 formed in the two sides of a hinge spring fixing portion 10. Thereafter, the pins 112 are deformed by heat stress to fix the hinge spring fixing portion 10. For example, the pins 112 made of a plastic are gradually squeezed in its axial direction with metal pins having flat end faces and heated to a high temperature, thereby fixing the hinge spring fixing portion 10.

Figure 5:
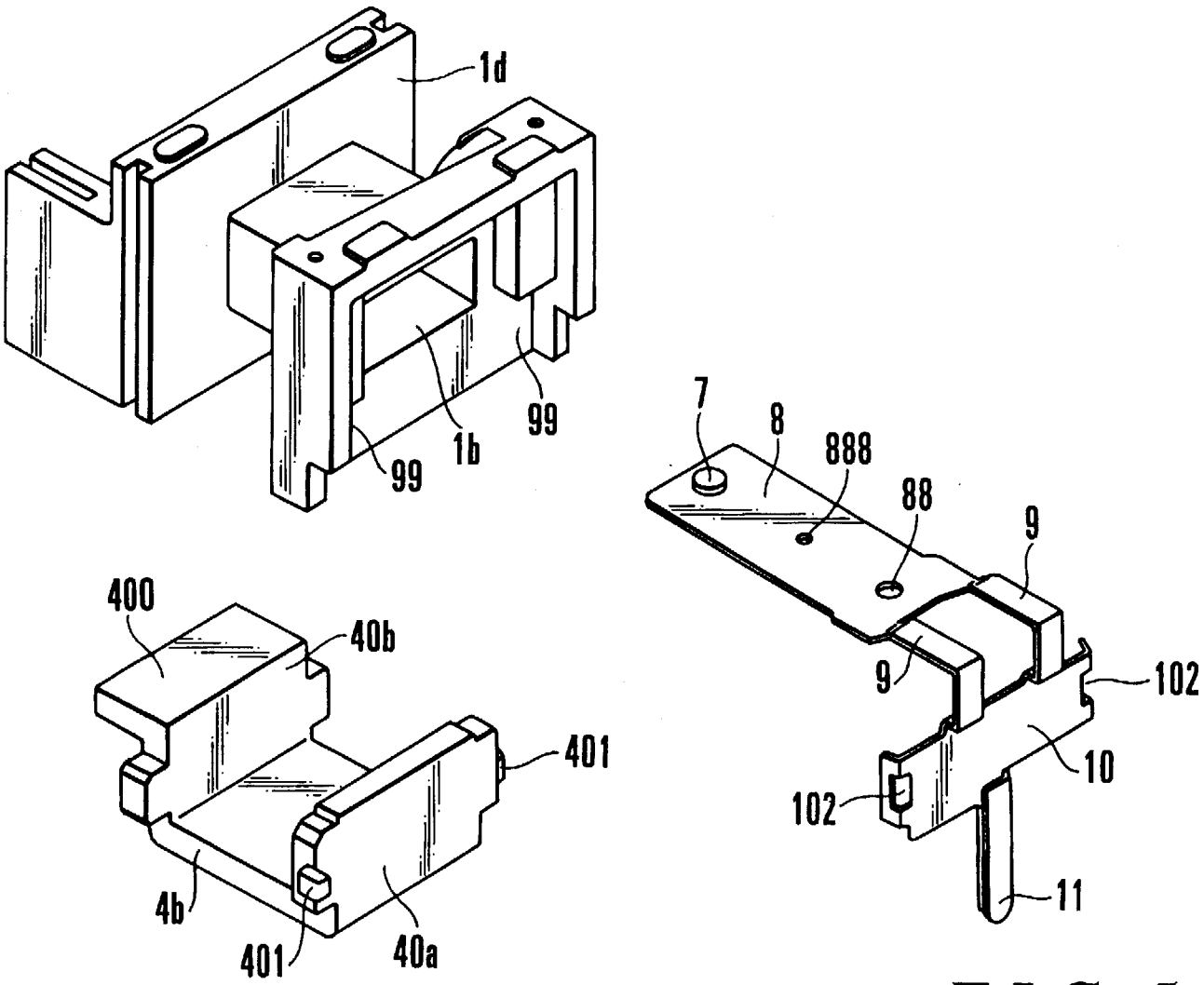
FIG. 5 is an exploded perspective view showing the main part of the main body of an electromagnetic relay according to the fourth embodiment of the present invention.

FIG. 5 shows the main part of the main body of an electromagnetic relay according to the fourth embodiment of the present invention and indicates still another method of fixing the hinge spring portion. In FIG. 5, the same portions as in FIGS. 1 and 2 are denoted by the same reference numerals, and a detailed description thereof will be omitted. Referring to FIG. 5, two end portions of a hinge spring fixing portion 10 are bent, and square window portions 102 are formed in the bent portions. Projecting portions 401 formed by half punching, like the pawl portion 12*c* shown in FIG. 2, are formed on the two sides of an upright portion 40*a* of a yoke 4*b*. Note that since the outward surfaces of the projecting portions 401 form curved surfaces, when the window portions 102 of the hinge spring fixing portion 10 engage with the window portions 102, the distal end of the hinge spring fixing portion 10 is slid along the surfaces of the projecting portions 401. Accordingly, the bending angle of the two end portions of the hinge spring fixing portion 10 is preferably an obtuse angle with respect to the surface of hinge spring fixing portion 10 which faces the spool. Clearance portions 99 are formed in the spool 1*d* for the projecting portions 401.

Figure 6:
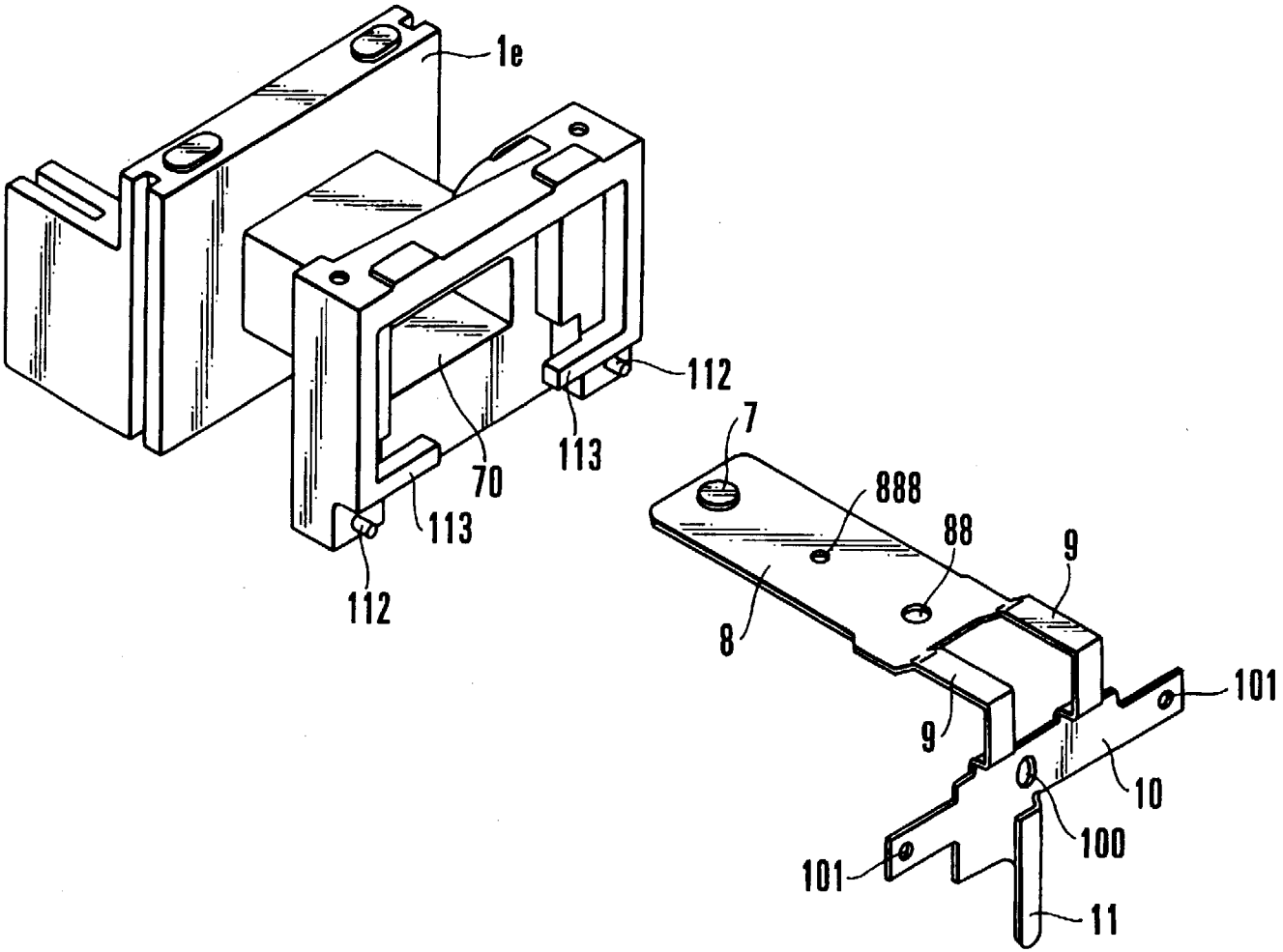
FIG. 6 is an exploded perspective view showing the main part of the main body of an electromagnetic relay according to the fifth embodiment of the present invention.

FIG. 6 shows the main part of the main body of an electromagnetic relay according to the fifth embodiment of the present invention having a structure as a combination of the first and third embodiments. In FIG. 6, the same portions as in FIGS. 1 and 2 are denoted by the same reference numerals, and a detailed description thereof will be omitted. Referring to FIG. 6, a pair of opposing rod-shaped projecting pieces 113 similar to those in FIGS. 1 and 2, and pins 112 similar to those in FIG. 4 are formed on the one-end face of a spool 1*e*.

Figure 7:
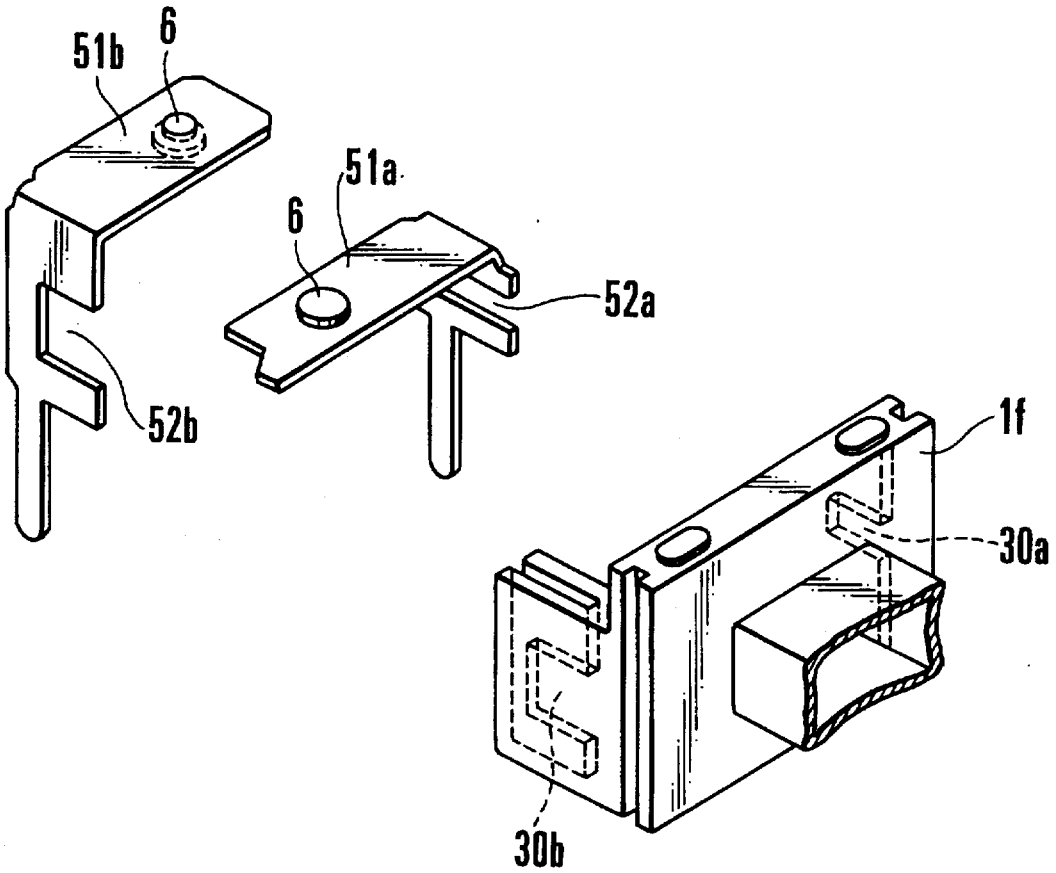
FIG. 7 is an exploded perspective view showing the main part of the main body of an electromagnetic relay according to the sixth embodiment of the present invention.

FIG. 7 shows the main part of the main body of an electromagnetic relay according to the sixth embodiment of the present invention and indicates another method of fixing the terminals. In FIG. 7, the same portions as in FIGS. 1 and 2 are denoted by the same reference numerals, and a detailed description thereof will be omitted. Referring to FIG. 7, recessed portions 52*a* and 52*b* respectively formed on the vertical hang pieces of terminals 51*a* and 51*b* fit with projecting portions 30*a* and 30*b* formed on the end faces of a spool 1*f* with interference fit of several ten μm.

Figure 8:
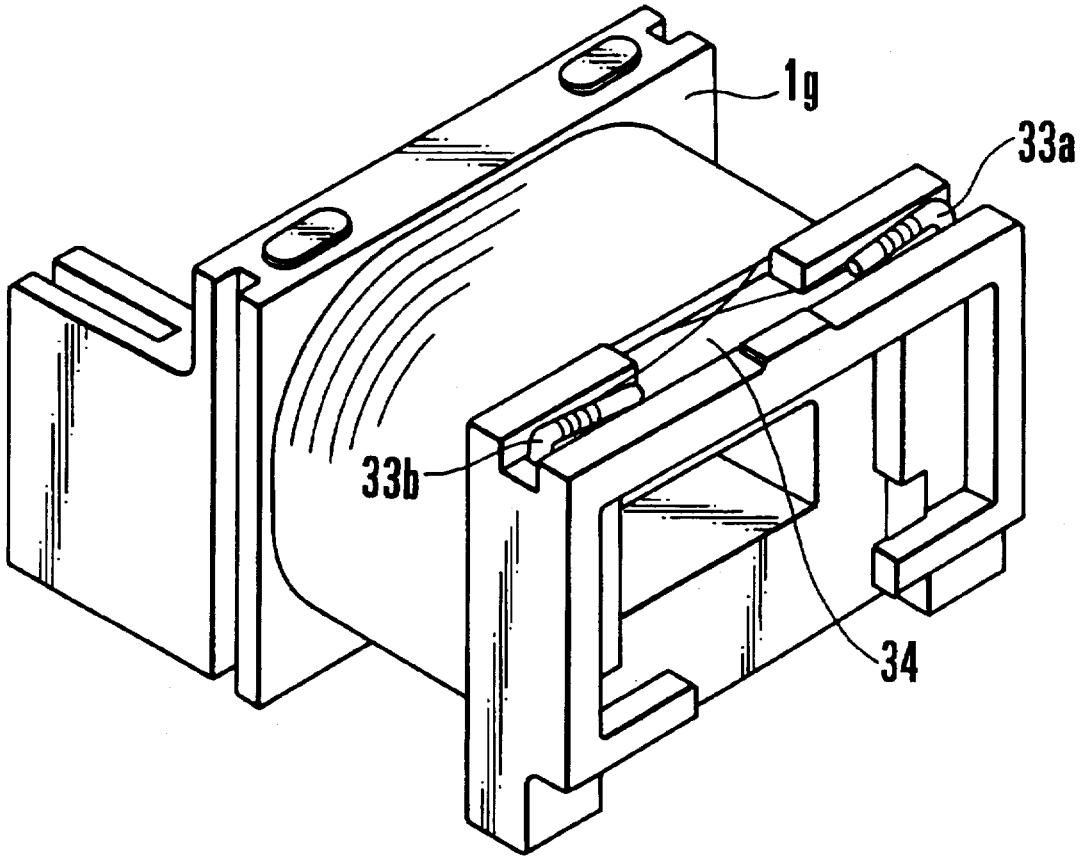
FIG. 8 is a perspective view showing the main part of the main body of an electromagnetic relay according to the seventh embodiment of the present invention.
Figure 9:
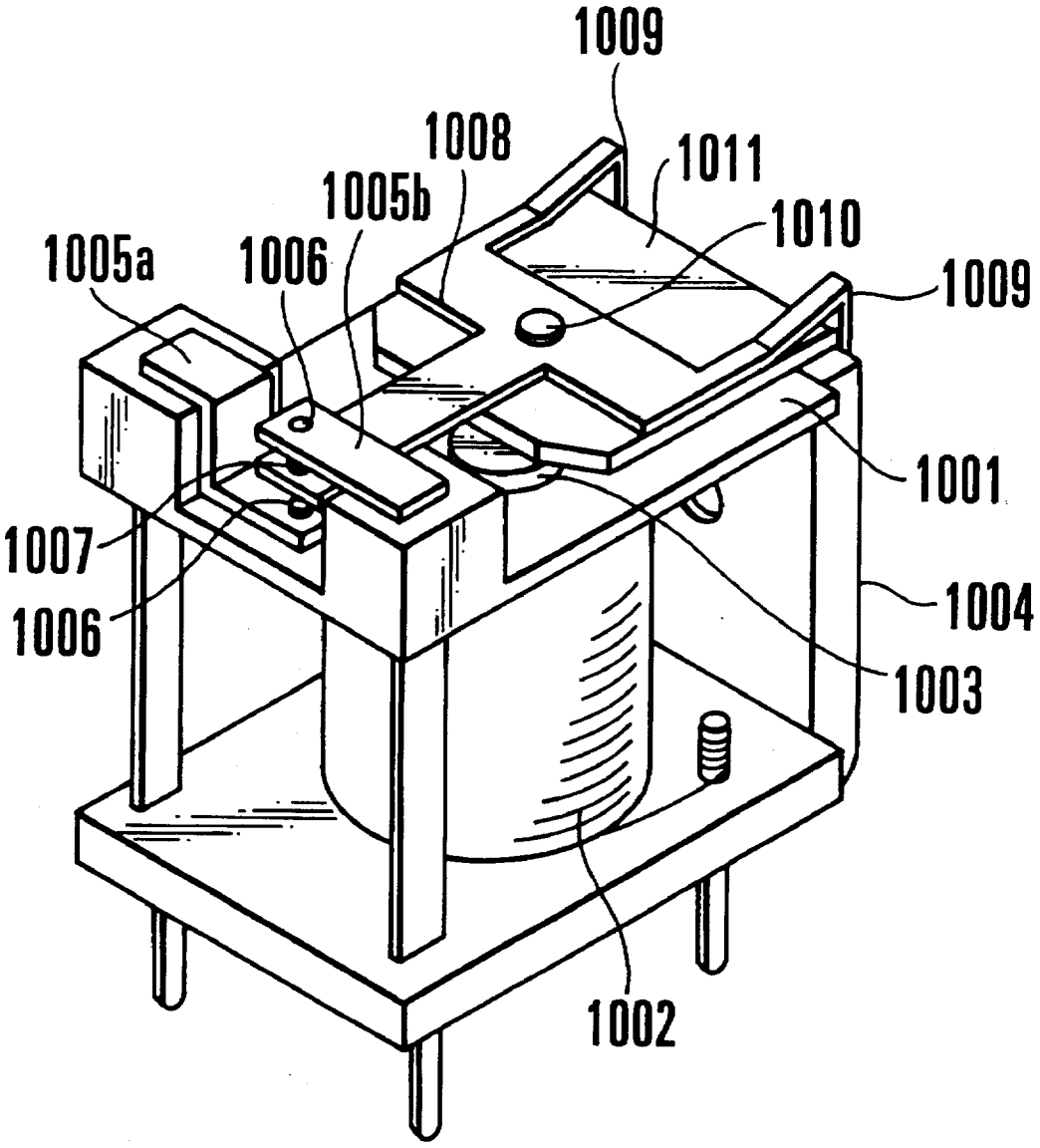
FIG. 9 PRIOR ART
FIG. 9 is a perspective view showing the main body of a conventional electromagnetic relay.

FIG. 8 shows the main body of an electromagnetic relay according to the seventh embodiment of the present invention for an improvement in the coil bobbin. In FIG. 8, the same portions as in FIGS. 1 and 2 are denoted by the same reference numerals, and a detailed description thereof will be omitted. Referring to FIG. 8, a pair of coil tie-up portions 33*a* and 33*b* exposed to the upper portion of a spool 1*g* are bent to oppose each other and are buried in a groove portion 34. With this structure, the height of the main body of the electromagnetic relay can be reduced. This arrangement is suitable for a structure in which the coil tie-up portions 33*a* and 33*b* are hermetically sealed with the inner wall of the case. In this case, the insulating performance between the coil and the contact can be further improved.

As has been described above, according to the present invention, the first effect is the low manufacturing cost. This is because the number of components is small, and because the assembling process and installation are simple.

The second effect is a high breakdown voltage. This is because the contact portion and the hinge portion are hermetically sealed with the cylindrical spool portion and the inner wall of the case, and because the opening portion of the case is sealed with epoxy-based adhesive.

The third effect is the compactness. This is because an extra space for fixing the yoke and the hinge spring fixing portion by caulking is not needed.

What is claimed is:

1. An electromagnetic relay comprising:

a spool having a through hole, a first end portion, and a second end portion opposite to said first end portion;

a cylindrical excitation coil wound on said spool;

an armature inserted in the through hole of said spool to operate upon excitation of said excitation coil;

a substantially U-shaped yoke fixed to said two end portions of said spool, said yoke having first and second opposing upright portions, and one end of said armature being in contact with an end face of said first upright portion of said yoke and the other end of said armature opposing an end face of said second upright portion of said yoke;

L-shaped hinge springs for setting said armature at a predetermined angle with respect to said yoke and urging said one end of said armature against said end face of said first upright portion of said yoke to ensure magnetic connection;

a movable spring having a movable contact at one end thereof, the opposite end of said movable spring, being connected to and extending from one end of said hinge springs, wherein said movable spring is connected to said armature;

a hinge spring fixing portion, extending from the end of said hinge springs that is opposite the movable spring, to support said hinge springs and said movable spring;

an attaching mechanism for attaching and fixing said hinge spring fixing portion on an outer side surface of said first upright portion of said yoke; and at least one terminal member fixed to one end portion of said spool by press fitting, said terminal member having a stationary contact adjacent to said movable contact of said movable spring.

2. An electromagnetic relay according to claim 1, wherein said attaching mechanism has a pair of rod-shaped projecting pieces formed on one end portion of said spool to oppose each other at a predetermined gap to form a predetermined gap with said outer side surface of said first upright portion of said yoke, an elongated hole formed at a center of said hinge spring fixing portion to extend in a longitudinal direction of said hinge springs, and a projecting portion formed on said outer side surface of said first upright portion of said yoke to engage with the elongated hole of said hinge spring fixing portion when said hinge spring fixing portion is inserted in a gap between said outer side surface of said first upright portion of said yoke and said rod-shaped projecting pieces.

3. An electromagnetic relay according to claim 2, wherein said hinge springs are set to have a width smaller than an opposing gap of said rod-shaped projecting pieces, and said hinge spring fixing portion is set to have a width larger than the opposing gap of said rod-shaped projecting pieces.

4. An electromagnetic relay according to claim 1, wherein said first and second upright portions of said yoke oppose the through hole of said spool, and an insulating distance between said excitation coil and said yoke is set by adjusting a length of said first and second upright portions of said yoke.

5. An electromagnetic relay according to claim 1, wherein said terminal member is substantially L-shaped and is comprised of first and second pieces, said first piece has said stationary contact, and said second piece has a projecting portion which projects in a press-fit direction toward said spool and is flush with said second piece, and a tongue piece formed by cutting from said second piece is cantilevered and parallel to said second piece.

6. An electromagnetic relay according to claim 1, wherein said movable spring and hinge spring fixing portion are connected to opposite ends of said hinge springs and are formed of a conductive metal to be integral with said hinge springs, and said hinge spring fixing portion has a common terminal member projecting to the opposite side of said hinge siring fixing portion as that to which said hinge springs are attached.

7. An electromagnetic relay according to claim 1, wherein said movable spring has a fitting hole that fits with a projection formed on a rear surface of said armature, and said movable spring is connected to said armature by fitting said projection of said armature in the fitting hole of said movable spring.

8. An electromagnetic relay according to claim 1, wherein an end face of said armature, on the end of the armature which is in contact with said end face of said first upright portion of said yoke, has a pawl portion thereon which engages with said outer side surface of said first upright portion of said yoke.

9. An electromagnetic relay according to claim 1, wherein a main body of said electromagnetic relay is accommodated in a substantially box-like case having one surface which forms an opening portion which is sealed with an epoxy-based adhesive.

10. An electromagnetic relay according to claim 1, wherein said spool has cylindrical portions at two end portions thereof to respectively accommodate said stationary contact and said hinge springs.

11. An electromagnetic relay according to claim 1, wherein said attaching mechanism has a pair of pins projecting from two sides of said first end portion of said spool, and a pair of holes formed in two end portions of said hinge spring fixing portion, and the holes of said hinge spring fixing portion are fitted on said pins of said spool and said pins are deformed by heat stress, so that said hinge spring fixing portion is fixed to said spool to come into contact with said outer side surface of said first upright piece of said yoke.

12. An electromagnetic relay according to claim 1, wherein said attaching mechanism has a pair of window portions formed in two end portions of said hinge spring fixing portion to have a predetermined shape, and a pair of projecting portions projecting from two end portions of said first upright portion of said yoke, and said window portions of said hinge spring fixing portion engage with said projecting portions of said first upright portion, so that said hinge spring fixing portion is fixed to said yoke to come into contact with said first upright portion.

13. An electromagnetic relay according to claim 1, wherein said terminal member includes:

a first piece having said stationary contact, and a second piece which forms a substantially L-shape together with said first piece and has a recessed portion, wherein said spool has a projecting portion projecting from said second end portion thereof, and when said terminal member is press-fitted in said spool, said recessed portion of said second piece is fitted on said projecting potion of said spool.

14. An electromagnetic relay according to claim 1, further comprising a groove formed in an outer circumferential surface of one end portion of said spool, and a pair of tie-up portions which vertically extend from a bottom portion of said groove and on which two ends of a winding wound on said excitation coil are tied, so that said tie-up portions are bent into said groove, after said winding is wound on said spool, to constitute a coil bobbin, and are hermetically sealed with said groove and an inner surface of said case.

15. An electromagnetic relay according to claim 1, wherein said first and second opposing upright portions of said yoke extend longitudinally in a direction perpendicular to the spool longitudinal axis.

16. An electromagnetic relay comprising:

a spool having a through hole, a first end portion, and a second end portion opposite to said first end portion;

an excitation coil wound on said spool;

an armature inserted in the through hole of said spool to operate upon excitation of said excitation coil;

a substantially U-shaped yoke, said yoke having first and second opposing upright portions respectively connected to said first and second end portions of said spool, wherein one end of said armature is in contact with an end face of said first upright portion of said yoke and the other end of said armature opposes an end face of said second upright portion of said yoke;

hinge springs biasing said armature into engagement with said end face of said first upright portion of said yoke;

a movable spring connected to and extending from one end of said hinge springs, and connected to said armature, wherein said movable spring includes a movable contact;

a hinge spring fixing portion connected to an end of said hinge springs opposite said movable spring;

an attaching mechanism which fixes said hinge spring fixing portion to said yoke; and at least one terminal member fixed to one end portion of said spool, said terminal member having a stationary contact adjacent to said movable contact.

17. An electromagnetic relay comprising:

a spool having a through hole, a first end portion, and a second end portion opposite to said first end portion;

an excitation coil wound on said spool;

an armature inserted in the through hole of said spool to operate upon excitation of said excitation coil;

a substantially U-shaped yoke, said yoke having first and second opposing upright portions respectively connected to said first and second end portions of said spool, wherein one end of said armature is in contact with said first upright portion of said yoke and the other end of said armature opposes said second upright portion of said yoke;

a pair of hinge springs biasing said armature into engagement with said first upright portion of said yoke;

a movable spring connected to and extending from one end of said pair of hinge springs, and connected to said armature, wherein said movable spring includes a movable contact;

a hinge spring fixing portion connected to an end of said pair of hinge springs opposite said movable spring;

an attaching mechanism which fixes said hinge spring fixing portion on an outer side surface of said first upright portion of said yoke; and at least one terminal member fixed to one end portion of said spool, said terminal member having a stationary contact adjacent to said movable contact.

* * * * *